US006964277B2

(12) United States Patent
Naber

(10) Patent No.: US 6,964,277 B2
(45) Date of Patent: Nov. 15, 2005

(54) TIE-DOWN FOR A BEACH UMBRELLA

(76) Inventor: Michael John Naber, 17882 Bishop Cir., Villa Park, CA (US) 92861

( * ) Notice: Subject to any disclaimer, the term of this patent is extended or adjusted under 35 U.S.C. 154(b) by 106 days.

(21) Appl. No.: 10/602,472

(22) Filed: Jun. 23, 2003

(65) Prior Publication Data

US 2004/0123887 A1 Jul. 1, 2004

Related U.S. Application Data

(63) Continuation-in-part of application No. 10/330,524, filed on Dec. 26, 2002, now abandoned.

(51) Int. Cl.[7] ..... A45B 3/00; A45B 15/28

(52) U.S. Cl. ..... 135/16; 135/98; 135/117; 135/120.4; 248/508; 248/533

(58) Field of Search ..... 135/16, 27, 33.2, 135/33.4–33.5, 120.4, 115, 118, 117; 52/2.25, 52/23; 248/503, 505, 507–509, 533; 410/101, 410/103

(56) References Cited

U.S. PATENT DOCUMENTS

| | | | | | |
|---|---|---|---|---|---|
| 256,580 | A | | 4/1882 | Maul et al. | |
| 1,150,731 | A | | 8/1915 | Barcus | |
| 1,315,497 | A | | 9/1919 | Higdon et al. | |
| 2,059,463 | A | * | 11/1936 | Kemp | 135/98 |
| 2,519,430 | A | | 8/1950 | Brown | 135/5 |
| 3,406,698 | A | * | 10/1968 | Hutchison | 135/92 |
| 3,477,453 | A | * | 11/1969 | Ulisse | 135/95 |
| 3,498,301 | A | | 3/1970 | Hulin | 135/1 |
| 3,693,641 | A | * | 9/1972 | Moss | 135/127 |
| 4,232,693 | A | | 11/1980 | Matsuda | 135/36 |
| 4,257,644 | A | * | 3/1981 | Stephens | 296/65.04 |
| 4,364,193 | A | * | 12/1982 | Visco | 43/1 |
| 4,640,332 | A | * | 2/1987 | Turner | 160/46 |
| 4,924,893 | A | | 5/1990 | Furey | 133/16 |
| 4,953,576 | A | * | 9/1990 | Connelly | 135/118 |
| 5,025,819 | A | * | 6/1991 | Taylor | 135/16 |
| 5,150,728 | A | | 9/1992 | Stark | 135/16 |
| 5,297,570 | A | * | 3/1994 | Conner | 135/16 |
| 5,301,706 | A | * | 4/1994 | Jones | 135/125 |
| 5,335,685 | A | * | 8/1994 | Dahulich | 135/156 |
| 5,441,066 | A | * | 8/1995 | Harris | 135/88.01 |
| 5,461,833 | A | | 10/1995 | Murray et al. | 52/155 |

(Continued)

*Primary Examiner*—Winnie Yip
(74) *Attorney, Agent, or Firm*—Gene Scott & Patent Law & Venture Group

(57) ABSTRACT

A beach umbrella provides an elongated support shaft having a pointed distal end inserted into a soft surface, and a proximal folding canopy positioned below an upper terminal end of the support shaft. The folding canopy provides a fabric panel stretched over a plurality of ribs engaged with the support shaft and extending radially from it to form a downwardly convex external surface. A flexible strap is attached over the upper terminal end of the support shaft and an opposing eyelet engaged with the tip of one of the ribs of the umbrella. A securing line is fixed at a distal end to a stake driven into the surface so the line forms a downwardly divergent angle with the support shaft. The flexible strap lies in contact with the external surface of the fabric panel and is joined at its upper end with the strap. Strap and line are arranged to point upwind to counter wind forces so that the umbrella cannot be blown over.

9 Claims, 1 Drawing Sheet

U.S. PATENT DOCUMENTS 5,579,794 A * 12/1996 Sporta ..... 135/88.01
5,598,668 A * 2/1997 Isom ..... 52/86
5,887,840 A * 3/1999 Hoffman ..... 248/503
6,009,891 A * 1/2000 Surface et al. ..... 135/98
6,397,865 B1 6/2002 Wilson et al. ..... 135/16

* cited by examiner

TIE-DOWN FOR A BEACH UMBRELLA

RELATED APPLICATIONS

This is a continuation-in-part application of a prior filed and currently application having Ser. No. 10/330,524 and file date of Dec. 26, 2002 now abandoned.

INCORPORATION BY REFERENCE

Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to restraint systems; particularly of the guy-wire type, and more particularly to a restraint for use in securing a beach umbrella in place.

2. Description of Related Art

The following art defines the present state of this field:

Maul et al., U.S. Pat. No. 245,580 describes a parasol attachment consisting of the two strands or cords connected to the parasol, and combined with the slide, through which the cords or strands are passed, and in which they are crossed.

Barcus, U.S. Pat. No. 1,150,731 describes a parasol having a cover on which stars are indicated relatively to a position on the cover which serves to indicate Polaris, and a stick for the parasol having an end secured to the cover at the said position, by which the said parasol may be pointed as desired and may be rotated with the stick as its axis.

Higdon, U.S. Pat. No. 1,315,497 describes a portable, collapsible dressing room comprising four corner posts adapted to be forced into the ground, four top rails extending between and detachably supported on the upper ends of the posts, and a single piece of foldable fabric permanently secured to three of said top rails and detachably secured to the fourth rail.

Brown, U.S. Pat. No. 2,519,430 describes a portable booth comprising a flat circular base member, a plurality of vertical post members detachably secured at their bottom ends to said base member in circumferential spaced relation, a horizontal annular member frictionally secured to said post members in vertical spaced relation with respect to said base member and mounted for slidable movement on said post members, a cylindrical flexible curtain depending from the periphery of said annular member and terminating adjacent said base member, a plurality of rigid rings secured to and encircling said curtain in vertical spaced relation, loop elements formed on said rigid rings and slidably receiving said post members, elastic bands secured to and encircling said curtain intermediate said rigid rings, and an auxiliary flexible curtain element depending from said annular member adjacent the inside of said curtain defining a clothes storage space between the auxiliary element and said curtain.

D'Ulisse et al., U.S. Pat. No. 3,477,453 describes s net adaptor for converting an umbrella to a substantially insect-proof shelter for personnel, comprising a circular dome-shaped portion made up of a plurality of wedge-shaped sections of a net-like material cut on a bias and joined together laterally with their uppermost terminal portions defining a relatively small circular opening permitting passage therethrough of the uppermost end of the umbrella's supporting pole, and their lowermost terminal portions defining a relatively large circular opening whose diameter is approximately the same as that of the umbrella top's largest diameter, gripping means at least a part of which is secured to the under side of said dome-shaped portion and adapted to establish a firm grip on the umbrella's top surface so as affirmatively to prevent relative movement between the dome-shaped portion and the umbrella's top surface, sidewall sections extending from the lowermost terminal portions of said wedge-shaped sections down to the ground which supports the vertically positioned umbrella's supporting pole, and means for securing the said sidewall sections to the ground, whereby to keep the adaptor firmly positioned in place covering the umbrella and forming a tent-like shelter for personnel with the umbrella top forming a roof and the adaptor's sidewall sections forming the sides of the shelter.

Hulin, U.S. Pat. No. 3,498,305 describes a collapsible tent comprising: a pyramidally shaped top panel of flexible material having a circular lower edge and an upwardly pointing apex; a side panel of flexible material having an endless upper edge secured to the circular lower edge of said top panel; a plurality of elongated webbing strips secured to the downwardly facing side of said top panel, each of said webbing strips extending from a first point on the lower edge of said top panel, across the apex of said top panel and to a second point on said lower edge of said top panel on the opposite: side of said lower edge from said first point, said webbing strips crossing each other at said apex and each of said webbing strips having a pair of free end portions at opposite ends thereof; engaging means secured to the downwardly facing side of said top panel and detachably engaging the free ends of said webbing strips to form bights in each webbing strip adjacent the lower edge of the top panel; a first-rigid ring having an outer periphery configured and dimensioned to mate with the inner periphery of said side wall panel adjacent the upper edge of the side wall panel, said first rigid ring extending through the several bights formed by said webbing strips and lending rigid support to the side wall panel of the tent; additional webbing strips secured to the upwardly facing surface of said top panel directly over some of said first mentioned webbing strips, each of said additional webbing strips being secured through said top panel to one of said first mentioned webbing strips and extending across the apex of said top panel; a suspension ring passed under said additional webbing strips at the apex of said top panel for suspending said tent; a second rigid ring having an outer periphery configured and dimensioned to mate with the inner periphery of the lower portion of said side wall panel; a plurality of spaced, flexible ties on the interior of said side wall panel tied around, and detachably retaining, said second rigid ring in a horizontal position in contact with the inner periphery of the lower portion of said side wall panel; a plurality of anchor rods each baying a hook-shaped portion at one end for detachably engaging said second rigid ring and anchoring said second rigid ring to the ground; and an adjustably colsable vertically extending closure element in said side panel.

Matsuda, U.S. Pat. No. 4,232,693 describes A folding umbrella including a central shaft, a movable frame consisting of ribs coupled to one end of the shaft, an unfurlable material coupled to the frame and a belt swingingly coupled at one end to an edge of the material whereby the umbrella may be furled not only when the umbrella is folded up but also when the umbrella is not folded up.

Furey, U.S. Pat. No. 4,924,893 describes a beach umbrella anchoring system comprising an anchor member comprising a container, in the form of a beach bag, for containing a weighting medium, such as sand, and a connector for connecting the container to a beach umbrella restraining device; and a beach umbrella restraining device comprising a flexible cable member, a releasable connector fixed to one end of the cable for releasably connecting the cable to a beach umbrella, a second releasable connector, fixed to the other end of the cable, for releasably connecting the cable member to the connector of the anchor member, and a third releasable connector, slidingly attached to the cable member intermediate the ends thereof for releasably attaching the cable member to the beach umbrella. The anchoring system may be supplied in the form of a kit comprising the anchoring member (beach bag) the restraining device, and a sand shovel for filling the container member with sand. The provision of the container member in the form of a beach bag allows the system to be readily carried to the beach along with other paraphernalia. The system serves to anchor beach umbrellas against being overturned and flailing about in sudden or unexpected gusts of wind.

Stark, U.S. Pat. No. 5,150,728 describes an umbrella having one or more magnetic fasteners attached thereto strategically located to provide support of an open umbrella to a metallic surface on a vehicle so that the umbrella can be self-supported adjacent the opening of a vehicle such as the door opening or trunk and would withstand and be supported on the surface in rains or wind. The device permits the user to have both hands free for removing or placing small children or articles in a vehicle.

Murray et al., U.S. Pat. No. 5,461,833 describes a general purpose sand anchor, including: a paddle shaped anchor base, curved like the face of a spade shovel, for use as a hand-held shovel for digging the hole into which it will be placed; a line, with one end joined to the anchor base at the center of its wider part and the other end joined to the anchor base at the end of its narrower part; a hook, which attaches to an object to be secured, joined to the line at a point above its connection to the center of the wider part of the anchor base; and a handle, which is used to remove the anchor base from the sand, joined to the line at a point above its connection to the end of the narrower part of the anchor base.

Wilson et al., U.S. Pat. No. 6,397,865 describes a tie-down for a table umbrella for preventing damage to a table umbrella. The tie-downs for a table umbrella include a plurality of rigid elongate members which are essentially made of stiff wire with each having a first hook-like end and a second hook-like end both of which are adapted to attach to a table and an umbrella; and also includes a plurality of coupling members each of which is essentially a flat, rigid strip-like piece having a plurality of holes spaced therealong for coupling a respective pair of elongate members one of which is attached to the table and the other of which is attached to the umbrella.

The prior art teaches a beach umbrella safety system, tent securing lines, a sand anchoring system, dressing booth anchorage, umbrella net securement, folded umbrella securement, tie-downs for an umbrella, magnetic fastening of an umbrella, and decorative securement for a parasol, but does not teach a beach umbrella strap and anchor line adapted for engagement with a beach umbrella in a manner to hold the umbrella in a fixed position against a wind force. The present invention fulfills these needs and provides further related advantages as described in the following summary.

SUMMARY OF THE INVENTION

The present invention teaches certain benefits in construction and use which give rise to the objectives described below.

A beach umbrella provides an elongated support shaft having a pointed distal end inserted into a soft surface, and a proximal folding canopy positioned below an upper terminal end of the support shaft. The folding canopy provides a fabric panel stretched over a plurality of ribs engaged with the support shaft and extending radially from it to form a convex upfacing surface. A flexible strap has an adjustable loop fitted over and tightened about the upper terminal end of the support shaft and an opposing eyelet engaged with the terminal end of one of the ribs. Adjustment is possible to secure the line between the end of the rib and the upper end of the support shaft. A securing line is fixed at a distal end of the strap and to a stake driven into the soft surface so the line forms a downwardly divergent angle with the support shaft. The flexible strap lies in contact with the external surface of the fabric panel. Because the strap and line and other hardware items of the invention are easily compacted and folded, one may carry them in a small pouch or sack for convenience.

A primary objective of the present invention is to provide an apparatus and method of use of such apparatus that provides advantages not taught by the prior art.

Another objective is to provide such an invention capable of shading a sunbather.

A further objective is to provide such an invention capable of withstanding a wind force.

A still further objective is to provide such an invention capable of being positioned and secured in a minimum amount of time with a minimum amount of effort.

A further objective is to provide such an invention capable of being folded into a small pouch when not in use.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawing illustrates the present invention. In such drawing

DETAILED DESCRIPTION OF THE INVENTION

Figure 1:
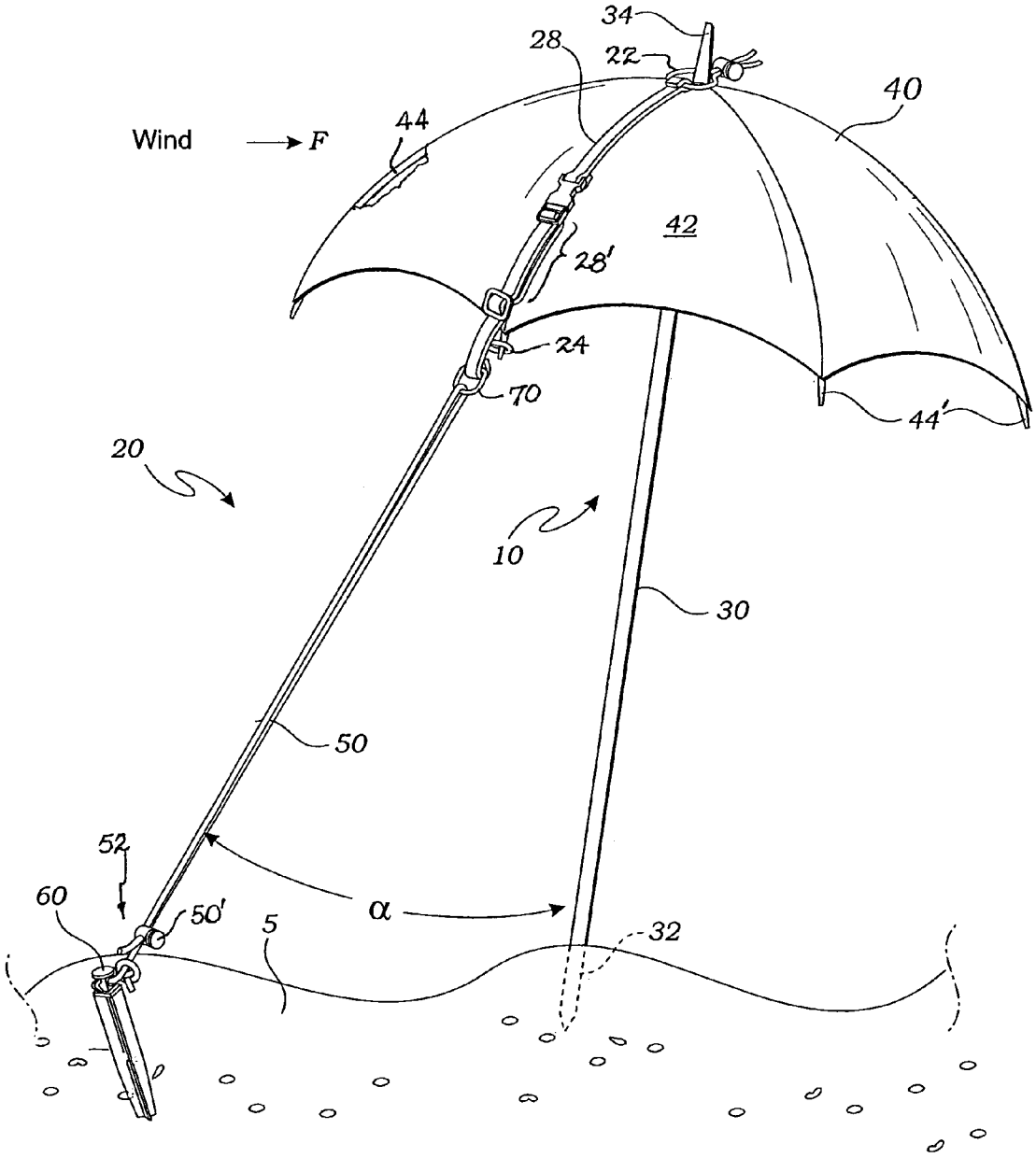
FIG. 1 is a perspective view of the preferred embodiment of the invention.

The above described drawing figures illustrate the invention in at least one of its preferred embodiments, which is further defined in detail in the following description.

The present invention is a means for securing an umbrella against a wind force; see FIG. 1. The invention is a combination of a folding beach umbrella 10 of any ordinary type, and an umbrella securing apparatus 20. The beach umbrella 10 provides an elongated support shaft 30 typically of wood or metal or other structural material. This support shaft 30 preferably has a pointed distal end 32 so that it may be more easily inserted or driven into a soft supporting surface 5 such as beach sand or garden soil, for instance for holding the umbrella in an upright attitude as shown. The umbrella 10 has a folding canopy 40 positioned near an upper end 34 of the support shaft 30. This is clearly shown in FIG. 1. The folding canopy 40 provides a fabric panel 42 stretched over a plurality of flexible metal ribs 44 hingably engaged with the support shaft 30 so that the ribs 44 may be positioned adjacent to the support shaft when the umbrella is closed (not shown), and, alternately, radially extended therefrom when the umbrella is opened (FIG. 1), as is well known in this type of umbrella construction. The folding canopy 40 forms a convex upfacing external surface, clearly shown in FIG. 1, when the umbrella is open.

The securing apparatus 20 includes an elongate flexible strap 28 made preferably of plastic or fiber cords so that it is not easily longitudinally deformed, and having at one end, an adjustable loop 22 which is fitted over, and tightened about the upper end 34 of the support shaft 30. At the other end of flexible strap 28 is an eyelet 24 engaged with the tip 44' of one of the ribs 44. The strap 28 is adjustable using a common and typical means for adjustment 28' so that the strap 28 may be tightened, thereby capturing the strap 28 on the umbrella 10 between end 34 and tip 44'. A securing line 50 is fixed at a distal end 52 to the supporting surface 5 preferably by attachment to a ground stake 60 driven into the supporting surface 5, as is well known in pitching tents and the like. The securing line 50 preferably forms a downwardly divergent angle $\alpha$ with the support shaft 30 and in this manner is able to apply a horizontal restraining force counter to the wind force F whenever the umbrella tends to be driven in the direction the wind F is moving. Preferably, the flexible strap 28 lies in contact with the external surface of the fabric panel 42 and in use takes a V-shape as it conforms to the surface of the fabric panel 42 at the point where the panel 42 overlaps the rib 44 to which the strap 28 is engaged. This helps enable the strap 28 to maintain its position on the umbrella.

Preferably, a ring 70 is placed terminally on the strap 28 and is used to attach the securing line 50 to the strap 28 as shown, and in this manner the fabric panel 42 or the rib 44 are not damaged when stresses are applied due to the wind F. Ring 70 enables the securing line 50 to be easily attached to the strap 28 and adjusted as to length using clamp 50'.

The invention is erected as follows: first the distal end 32 of the umbrella 10 is driven into the supporting surface 5 and the support shaft 30 is tilted slightly away from the direction of the wind F, as shown in FIG. 1. Next, the adjustable loop 22 of the flexible strap 28 is placed over the upper end 34 of the support shaft 30 and tightened into a strong frictional engagement with the support shaft 30. The flexible strap 28 lies in contact with the folded canopy 40; the strap 28 being placed in alignment with the wind direction F and extending from the upper end 34 of the support shaft 30 in a downward attitude. Next the umbrella canopy 40 is opened and secured in the open attitude as shown in FIG. 1. Next, the eyelet 24 is secured about a selected one of the rib tips 44', preferably, the tip 44' that points most closely toward the direction of the wind. Next, the strap 28 is tightened using adjustment 28' so as to apply a tension between eyelet 24 and loop 22. Ring 70 now hands free of the end of the canopy 40 and is secured to line 50 which is next secured to the stake 60 which was previously driven into the surface 5 upwind from the support shaft 30. When wind forces F are applied to the canopy 40 the support shaft 30 is secured in place by strap 28, line 50 and stake 60.

Clearly, two or more of the umbrella securing apparatus 20 may be used with a single umbrella 10 to more rigorously hold the umbrella stationary in a wind. In such cases, the securing apparatuses 20 are preferably attached to the umbrella and spaced apart.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A shading apparatus comprising in combination: a folding umbrella providing an elongated structural supporting shaft having a lower end thereof adapted for securement relative to a supporting surface for holding the umbrella in an upright attitude, an upper end thereof supporting a canopy; the canopy providing a fabric panel stretched over a plurality of folding ribs hingably engaged with the support shaft, each of the ribs movable between a position adjacent to the supporting shaft and a position extending radially therefrom, the ribs each terminating with a rib tip, the canopy forming a convex upfacing surface with the ribs in the radially extending position; and a means for securing the umbrella including an elongate flexible strap having, at one end thereof, an adjustable loop fitted over, and thereby secured on, the upper end of the supporting shaft, and at the other end an eyelet engaged with one of the rib tips, the flexible strap further providing a means for length adjustment for tensioning the flexible strap between the upper end of the supporting shaft and the one of the rib tips; the securing means further comprising a securing line removably fixed at a proximal end thereof to the flexible strap and at a distal end thereof to the supporting surface.

2. The combination of claim 1 further comprising a ground stake fixing the distal end of the securing line to the supporting surface.

3. The combination of claim 1 further comprising a ring engaged with the other end of the flexible strap, the ring receiving the proximal end of the securing line.

4. The combination of claim 1 wherein the supporting shaft is pointed at the lower end thereof for piercing the supporting surface.

5. An apparatus in combination with a beach umbrella, the apparatus comprising: an elongate flexible strap having, at one end thereof, a loop for fitting over, and thereby being secured on, an upper end of the beach umbrella, and at an other end of the flexible strap, an eyelet of a size for tightly engaging a rib tip of the beach umbrella when a canopy of the beach umbrella is in the open state; the flexible strap further providing a means for length adjustment sufficient for tensioning the flexible strap between the upper end of the beach umbrella and the rib tip and thereby capturing the other end of strap on the umbrella; the flexible strap further providing a terminally engaged ring; the apparatus further comprising a securing line removably engaged with the terminally engaged right of the flexible strap at a proximal end and at a distal end of the securing line, to a surface used for supporting the beach umbrella; the securing line forming a downwardly divergent angle with respect to a support shaft of the umbrella.

6. The combination of claim 5 further comprising a ground stake fixing the securing line to the supporting surface.

7. A method for securing a beach umbrella comprising the steps of: providing a folding umbrella having an elongated structural supporting shaft; securing a lower end of the shaft relative to a supporting surface for holding the umbrella in an upright attitude; supporting a canopy at an upper end of the shaft; the canopy providing a fabric panel stretched over a plurality of folding ribs hingably engaged with the support shaft, each of the ribs movable between a position adjacent to the supporting shaft and a position extending radially therefrom; terminating each of the ribs with a rib tip; tightening an adjustable loop of a flexible strap over the upper end of the supporting shaft; securing an eyelet of the flexible strap over one of the rib tips; adjusting the flexible strap to provide tension between the rib tip and the upper end of the supporting shaft; and fastening a securing line between the flexible strap and the supporting surface.

8. The method of claim 7 further comprising the step of securing the securing line to the supporting surface with a stake.

9. The combination of claim 7 further comprising the step of providing a ring engaged with the flexible strap and engaging the securing line with the ring.

* * * * *